United States Patent [19]

David

[11] Patent Number: 4,746,121

[45] Date of Patent: May 24, 1988

[54] THREE-BAR AND BALL GAME APPARATUS AND METHOD OF USING SAME

[76] Inventor: Constant V. David, 4952 Field St., San Diego, Calif. 92110

[21] Appl. No.: 11,583

[22] Filed: Feb. 6, 1987

[51] Int. Cl.[4] ..... A63B 67/14

[52] U.S. Cl. ..... 273/110; 273/128 A; 446/170; 446/447

[58] Field of Search ..... 273/109, 110, 120, 128 A; 446/170, 447

[56] References Cited

U.S. PATENT DOCUMENTS

| | | | |
|---|---|---|---|
| 145,385 | 9/1873 | Bean | 273/120 R |
| 1,154,094 | 9/1915 | Cassard | 273/109 |
| 1,595,071 | 8/1926 | Carlson | 273/110 |
| 3,985,360 | 10/1976 | Meyer | 273/109 |
| 4,669,727 | 6/1987 | David | 273/110 |

FOREIGN PATENT DOCUMENTS

| | | | |
|---|---|---|---|
| 842735 | 6/1939 | France | 273/108 |

OTHER PUBLICATIONS

"Crestline Games and Gifts of Distinction", Crestline Manufacturing Company, Santa Ana, California, 1970.

*Primary Examiner*—Richard C. Pinkham
*Assistant Examiner*—Gary Jackson

[57] ABSTRACT

A ball positioned between three circular cross-section bars acting as support. The bars are substantially parallel and oriented generally vertically. One end of each bar is partly restrained but permits full rotation of the bar about its longitudinal axis, but only limited motion laterally. The other bar end is partly restrained by a structure and is controlled by an operator's hand for providing limited bar movement. Two of the bars have handles and the third bar position can be set and remains fixed during a game. The bar cross-section diameters vary lengthwise between bar ends. The ball is urged by means of one specially shaped first bar to move upward against a recall force. A second bar with handle is controlled by another hand. The combination of the variations of the bar diameters and shapes lengthwise with the recall force acting on the ball creates difficulties for the ball to move axially, though urged to do so. The recall force can be generated by gravity and/or a spring, it increases as the ball moves farther from its staring point. The object of the game is to make the ball travel as far as possible from that location. Various coordinated motions of both hands are needed to control the bars and maximize the ball travel, requiring both manual skill and dexterity, which can then be measured and/or improved with practice.

32 Claims, 2 Drawing Sheets

THREE-BAR AND BALL GAME APPARATUS AND METHOD OF USING SAME

BACKGROUND OF THE INVENTION

The present invention relates to a game of skill in manual control and requires the coordinated use of both hands and fingers in three directions: laterally in two orthogonal directions and rotationally. The skill and dexterity of a game player or operator are measurable. The apparatus may also be utilized to help players develop and improve manual skill and dexterity.

Many games based on the use of manual dexterity have been developed in the past. Two have recently been conceived by the present inventor, one with one bar (U.S. Pat. No. 4,561,656) and another with two bars (U.S. Pat. No. 4,669,727. They most often involve the use of only one hand, seldom two concurrently, except for the second Patent reference cited. Usually, an apparatus conceived for game-playing does not provide the gradual transitional phase between on and off, with the feedback needed to exercize control, while the operator attempts to correct for failings that can be foreseen. Seldom do such games and apparatus provide a simple, automatic, visual and permanent record of the degree of skill then achieved.

Efforts are continuously being made to develop new games and toys which provide opportunities for persons of various ages to measure and gradually improve their manual dexterity. For example, it is desirable for the operator to be able to increase the level of the difficulties to be overcome in order to succeed as he (she) becomes more proficient. Also, it is desirable to enable the operator to alter the degree of difficulty built in the apparatus to match the stage of manual skill development which has been reached or will be reached in the future with practice.

In view of this background, the present invention provides those features which skill games require and offers improvements in ways to develop and measure the degree of manual skill and dexterity which demand the coordination of both hands by means of the fingers.

SUMMARY OF THE INVENTION

It is therefore a primary object of the present invention to provide a new and improved apparatus and method of use which requires the combined and coordinated use of both hands and the fingers, said use involving simultaneously hand, wrist, finger and arm motions.

It is another object of the present invention to provide an apparatus which can be used by people of all ages, requires very little effort and measures both manual skill and dexterity.

It is still another object of the present invention to provide an amusement apparatus which can be changed and adjusted to vary the degree of difficulty of its operation to match the degree of proficiency of the operator and/or game player.

It is still another object of the present invention to provide an amusement apparatus which is simple and safe to operate so that its operation presents no risk and/or danger either to the operator/game-player or observers.

It is still another object of the present invention to provide an amusement apparatus that enables the players and/or game observers to witness, measure and record the degree of skill demonstrated by the operator.

It is finally another object of the present invention to provide an apparatus which enables the operator to develop and improve his (her) manual skill and dexterity in coordinating and controlling basic types of movements of each hand and fingers, and also of both hands and fingers thereof simultaneously.

Accordingly, the present invention provides an apparatus that is simple, easy and safe to operate, which can be used by inexperienced and very expert players alike with equal satisfaction, from the use of which all can equally benefit.

DETAILED DESCRIPTION OF THE INVENTION

Two basic embodiments of the present invention are described herein. They constitutes and represents two basic manners of moving the ball in a general direction easily identifiable: (1) horizontal, or (2) vertical. In the embodiment where the ball moves vertically, it is simpler and more advantageous to exploit the recall effect on the ball caused by gravity (ball weight). However, the recall force is constant, unless a recall spring is added. The challenge presented by a game must consist in trying to urge the ball upward, against the gravity pull. The ball travel starting point is then the lowest end of the bars whose longitudinal axes are then vertical. This represents the preferred embodiment of the invention.

In an alternate embodiment of the present invention, the recall force exerted on the ball must be all artificially created, i.e. by means of a recall spring. Access to the bars is facilitated inasmuch as both ends of each bar become accessible through both supporting ends of the system holding structure. Each one of two bars may thus have one handle positioned at one corresponding end of the supporting structure, for ease of operation.

Figures 1, 2, 3, 4, 5, 6, 7, 8, 9, 10:
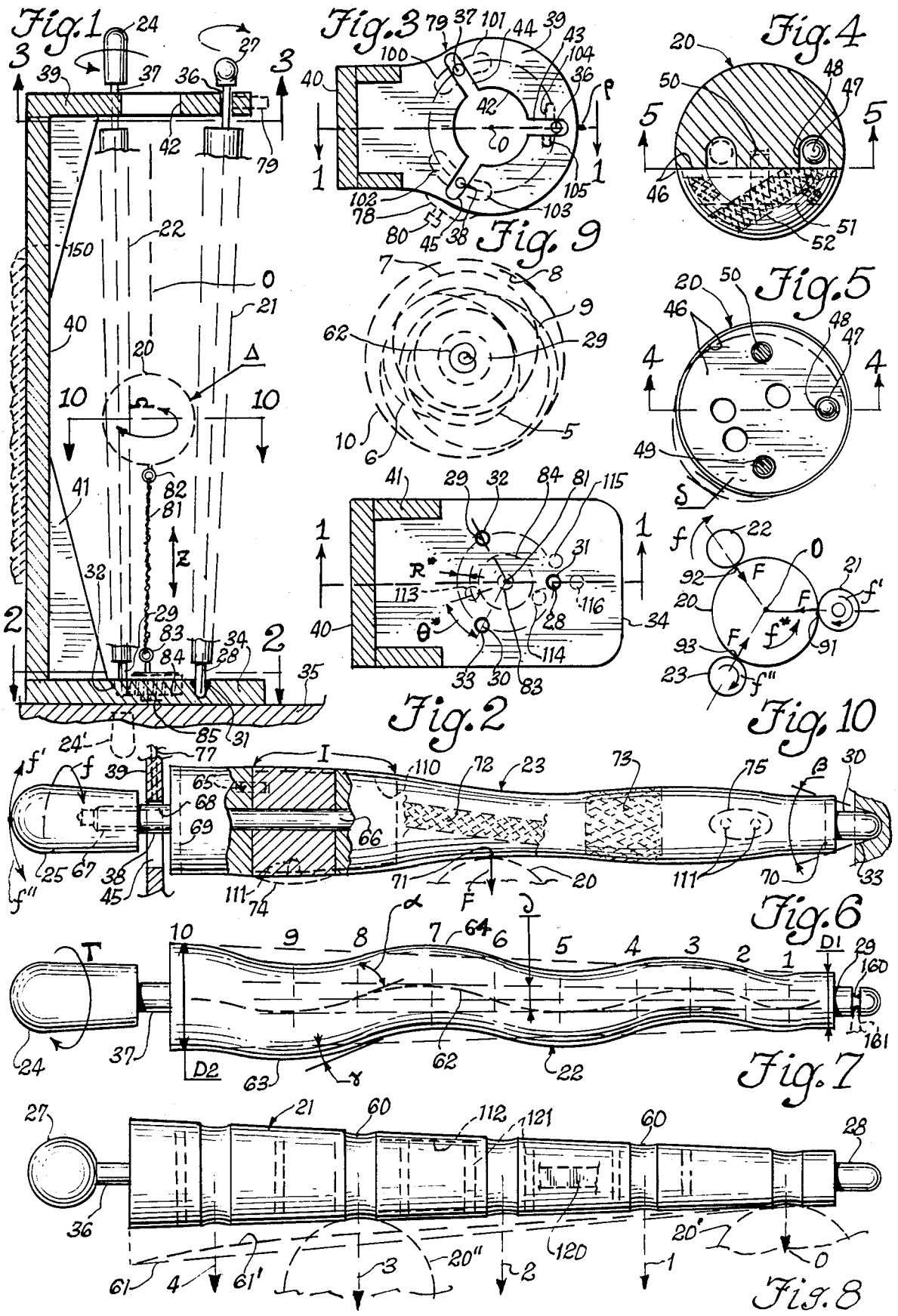
FIG. 1 is a midsectional elevation view of the bar and holding structure taken along section line 1—1 of FIG. 2 or 3.
FIG. 2 is a top plan view of the apparatus structure base as seen from section line 2—2 of FIG. 1.
FIG. 3 is a plan view of the apparatus structure top as seen from section line 3—3 of FIG. 1.
FIG. 4 is a partial sectional elevation view and a partial external view of the ball seen from section line 4—4 of FIG. 5.
FIG. 5 is a sectional plan view of the ball along its assembly plane and taken along section line 5—5 of FIG. 4.
FIG. 6 is a partial sectional elevation view and partial external view of the control bar.
FIG. 7 is an elevation view of the actuation bar.
FIG. 8 is an elevation view of the guiding bar.
FIG. 9 is a diagrammatical representation of contiguous sections of the actuation bar showing their relative angular positions along the bar length.
FIG. 10 is a plan sectional view of the ball and of the three supporting bars taken along section line 10—10 of FIG. 1.

Preferred Embodiment Description:

Referring to FIGS. 1 to 3, the preferred embodiment of the present invention is schematically illustrated. A ball 20 is supported by the external surfaces of three bars 21, 22 and 23. Bar 23 is not shown in FIG. 1 drawing, being located in the cut off half of the apparatus, although shown in FIG. 10. Bars 21 and 23 have a quasi circular cross-section and a quasi straight centerline or longitudinal axis. Bar 22 is referred to as actuating bar because it is used to make the ball rotate and urge it upwardly, as described later. Bars 22 and 23 both have at the upper end a handle, 24 and 25 respectively, for manipulation by an operator. Bar 21 is equipped with a round grip 27 to permit occasional setting adjustements. At their other ends, all bars have cylindrical tips such as 28, 29 and 30, all terminated by a hemispherically-shaped end lodged in and restrained by conical lodgings 31, 32 and 33, respectivelly, located in the structure base 34 set on a table or desk top 35. The bar weights are thus supported by base 34 and the bar lower ends are axially and laterally restrained by the conical surfaces of the lodgings. At the other end of each bar, shafts such as 36, 37 and 38 are restrained by holding structure top 39 mounted on structural support member 40. Top 39 and base 34 are mounted on member 40 and the structural assembly is stiffened and reinforced by braces such as 41. Top 39 is provided with a central hole 42 and three openings 43, 44 and 45 that connect openly with hole 42, so that the bars may be inserted in place into the apparatus, through hole 42.

Ball 20 depicted in FIGS. 4 and 5 typically consists of two unequal halves, each one having a common separation or assembly plane 46 for enabling a player to have access to ballast weights such as 47 lodged in cavities such as 48. A plurality of such cavities is provided at various angular and radial locations as illustrated in FIG. 5, so that the weight of the ball and its center of gravity (CG) may be adjusted at will. Two positioning pins 49 and 50 insure that both ball halves may be separated and/or reassembled in the correct position and held together. The quasi-spherical surface of the ball may be coated with materials having various coefficients of friction, as outlined by partially shaded bands 51 and 52 located in a preset manner with respect to plane 46 or/and the ballast cavity positions. Such coefficients of friction may be high or low as programmed.

FIGS. 6 to 8 depict the three bars. They are shown in an horizontal position for illustrative purpose. Both the tips and the shafts positioning and holding the bars have been identified earlier as have the bar handles. Bar 21 of FIG. 8, referred to as guide bar, remains fixed during a game and serves as a track against which ball 20 must constantly and continuously be pushed. It is typically divided into sections or segments separated by vary shallow grooves such as 60. In FIG. 8, five grooves are shown and numbered 0 to 4, groove 0 being the starting point of a game and groove 4 representing the highest level to which the ball may be raised (or urged to rise). The ball is shown positioned in phantom lines at level 0 (ball 20') and at level 3 (ball 20''), as examples. The external surface of bar 21 may not be of revolution, as indicated by phantom line 61, so that different track "slopes" correspond to various angular positions of bar 21 about its longitudinal axis, when set and locked thereat.

Referring now to FIG. 7, bar 22 referred to as actuation bar represents the means by which the player is enabled to urge ball 20 upward. To that effect, its external surface can be visualized as a slightly conical surface of revolution that has been helically wound around the bar horizontal axis. Another way to describe it is to see it as a stack-up of circular sections such as 1 to 10, the centers of each sections being located on an helix 62 having a large pitch angle $\alpha$ (70 to 80 degrees), as shown at station 8. The diagram of FIG. 9 described later illustrates this. Pitch angle $\alpha$ may vary along the bar length, as discussed in the next section. The manner in which bar 22 external surface interacts with the ball spherical surface at their contact point is also discussed there. A rotation of bar 22 by means of handle 24 thus urges ball 20 to either left or right (up or down when the bar is vertical), depending on the handle rotation direction.

The third bar 23 (FIG. 6) is used to perform two functions: (1) maintain ball 20 in constant and continuous contact with bar 22, and (2) depending on its construction, alter the response of ball 20 to the urging created by bar 22. Performance of the first function only does not require the manual use of handle 25. Thus, in such instance, spring loading applied onto shaft 38 will satisfy this requirement. However, performance of the second function necessitates forced rotation of bar 23 external surface. At this juncture, two bar 23 embodiments need be described, in the instance where the same bar can easily be converted from one embodiment to the other by means of locking pins such as 65 placed between adjacent segments. The result is basically three constructions and two bar embodiments: (1) bar external surface moving with the handle, i.e. one-piece bar structure or locked segments-handle assembly, and (2) unlocked segments independent from one another and from the handle. Such combinations of constructions and embodiments can also apply to guide bar 21. The solid bar construction is simple enough and needs no further elaboration.

The construction of the segmented bar embodiment is now described. The bar backbone consists of a stem 66 extending from handle 25 to tip 29. Stem 66 engages handle 25 by means of threaded end 67. Shaft 38 consists of a sleeve 68 and a flange 69 which are free to rotate on stem 66 and separate the handle from the first upper segment. A locking pin similar to 65 may be inserted in lodgings (not shown) between the first upper segment and flange 69 when the segments are to be locked together. A similar arrangement is also provided at the bar other end where flange 70 may be made part of stem 66 and tip 30. Provisions are made for either locking the first lower segment to flange 70 or unlocking it, as just described. The cone angle $\beta$ is large enough to enable the operator to swing or laterally move handle 25 freely as indicated by arrows f' and f''. The bottom of lodging 33 may be either shaped as a cone apex or rounded off hemispherically as shown. In either case, the hemispherical end of tip 30 insures that any lateral motion or swinging of bar 23 does not affect its longitudinal position, causing "jittering" of ball 20, within the movement limits imposed by the guiding surfaces of openings such as 45.

The interaction of bar 23 (and/or bar 21 as well) with ball 20 at a common contact point 71 can be affected in various ways by: (1) the rotatability or lack of it of the segments, (2) the friction coefficients of either surfaces in contact, (3) the slope of the bar surface at point 71 with respect to the bar axis, (4) the amount of force F exerted by the bar on ball 20, and (5) the amount of lateral displacement imposed by the player on handle 25 in a direction perpendicular to arrows f'-f''. The manner by which these factors may be exploited is discussed in the next section. The means therefor are now described. The friction coefficients may be altered by coating the segment surfaces locally as shown by cross-hatched areas such as 72 or 73. The effects of the rotatability or lack of it of the segments may easily be deduced by a reader familiar with the art. The relative slope made by the tangency plane common to both surfaces at point 71 with the bar axis (imperfect reference line, but approximate enough) varies with the general contour of the bar external surface and also with any local surface contour variations which may be provided by low-rising protuberances such as 74 and 75. Their locations can be rendered movable and adjustable. They can be construed as obstacles which should be avoided by the ball, hence by the players in their maneuvering of the ball rising position.

It is understood that any lateral movement of handle 25 changes the position of the bar axis with respect to the vertical direction, hence the slope mentioned earlier. For that reason, the bar longitudinal axis is called an imperfect reference line, though satisfactory enough for the purpose of this disclosure, because of the limitations imposed on the handle lateral motion. Force F may vary considerably in magnitude, depending upon the latitude given to the player by the apparatus. Force F magnitude could vary from a low quasi-constant level to a high level if left entirely to the player's election. Two basic approaches are described for providing either one of these two extreme possibilities. The second possibility is naturally offered when the player is given full lateral control of both handles 24 and 25 and bar 21 is fixed, no further elaboration is needed here. However, if either one of handles 25 and 27, or both, are made laterally movable but without possibility of player's control action, force F magnitude and variations thereof can be predetermined and programmed in a predictable and repeatable manner.

A simple and direct way to achieve this is schematically indicated in FIGS. 1, 3 and 6 drawings. A compression spring not shown here for simplicity sake, but described later in details in FIG. 15, pushes inwardly (toward arbitrary true vertical central axis 0) on shaft 38 by means of rod 77 located and guided in housings such as 78 and 79 not shown in details but by location. An adjustment by screw 80 can be used to set the spring compressive action, thus the magnitude of force F. Changing the spring provides the adjustment in force F variation with handle lateral displacements. The implications and uses of this feature are discussed in the next section. It will be obvious to readers familiar with the art that the lateral displacements of handle 24 are the only linear type of motion left available to the player, with the rotational degree of intervention provided by the handle, if the segments are locked. If not, depending on the degree of friction existing between the ball and the bar surfaces, only lateral movements, inwardly or sideways, or combinations thereof are possible. Next section discussion elaborates further on this subject.

Figures 11, 12, 13, 14, 15, 16, 17, 18, 19:
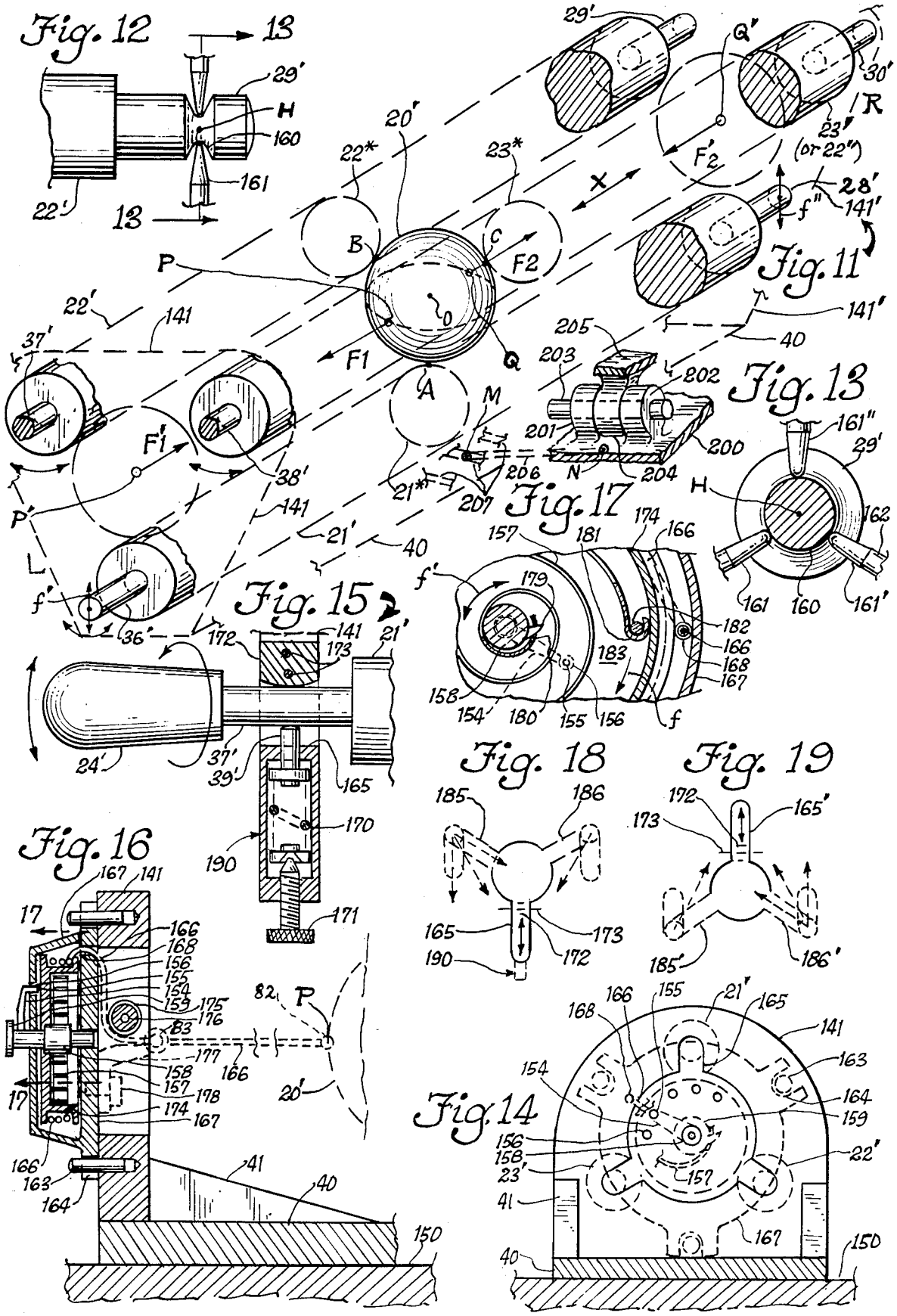
FIG. 11 is a diagrammatical perspective view of the bars and ball system shown operating in the horizontal position in an alternate embodiment of the invention.
FIG. 12 is a partial elevation view of the restrained end of a bar, when used in a horizontal position.
FIG. 13 is a sectional view of the bar restraint of FIG. 12 taken along section line 13—13.
FIG. 14 is an end view of the structure supporting the system of ball and bars in the horizontal position.
FIG. 15 is a partial elevation sectional view of the bar end and handle, shown supported by an adjustable spring.
FIG. 16 is a partial elevation sectional view of the supporting structure and ball recall spring system.
FIG. 17 is a partial planar sectional view of the ball recall spring system taken along section line 17—17 of FIG. 16.
FIG. 18 is a schematic diagram showing the types of displacements which the bar movable end is permitted, when the two ball control bars are located above the ball.
FIG. 19 is a schematic diagram showing the types of displacements which the bar movable end is permitted, when the two ball control bars are located below the ball.

Another approach, compatible with any of the others, for influencing the ball response to upward urgings may also be provided by a force that adds to the natural pull down of gravity, in a manner which can relate to both the amount of ball rising and the total amount of rotation of the ball needed to do so. This is schematically illustrated in FIGS. 1 and 3. A spring such as a rubber band 81 can be attached to ball 20 by fastener 82 located at the ball bottom and to base 34 by fastener 83. This provides a coupling between band tension and the number of turns which ball 20 makes on its way up. Another construction includes a flexible line which replaces the rubber band. Spring action can be provided inside lodging 84, shown in phantom lines, for causing the line to wind up around a drum arrangement which is caused to turn against the action of a watch-like main spring. The spring force can be adjusted by means of a set screw 85 located on the bottom face of base 34. Details of this construction are shown in FIGS. 16–17 in the case of the alternate embodiment.

FIG. 9 shows several circles in phantom lines which correspond to various identified cross-section outlines of actuation bar 22. The circles are identified by the order numbers assigned to the various cross-sections used as examples, starting from the left end (upper end) of the bar. Helix 62 is shown as a spiral in projection. This representation will help the reader in visualizing the outer contour of bar 22 which plays the major role in the operation of the invention.

FIG. 10 shows how ball 20 becomes and is kept automatically centered between the three bars at contact points 91, 92 and 93. For the purpose of the description, guide bar 21 and "push" bar 23 (pressure or restraining bar) are assumed to be equipped with unlocked segments. In such instance, when bar 22 is caused to rotate in direction f, ball 20 rotates in direction f* and the segments of bars 21 and 23 rotate in directions f' and f'' respectively. If the segments were locked, either one of two things might happen depending on the amounts of friction involved: (1) the whole bar 21 may rotate and the whole bar 23 may also rotate if spring loaded, and (2) friction torques generated by the bar rotations are higher than the friction torque generated at point 92 and the ball surface is forced to slide on the bar surfaces. Again, the implications and consequences thereof are discussed in the upcoming section.

Alternate Embodiment Description:

The illustrations pertaining to this embodiment are shown in FIGS. 11 to 19. They incorporate construction details applicable to the preferred embodiment, but do not elaborate on those details which have already been described and are common to both embodiments. To help the reader understand the transformation of vertical bar usage to horizontal bar usage, a reference is made in FIGS. 1 and 7 to the minimal but basic differences existing between the two embodiments needed to go from a first usage mode to a second usage mode. In FIG. 1, the table or desk top on which the apparatus must rest in a horizontal position is shown in phantom lines as 150. In FIG. 7, the axial restraint of a bar required in the horizontal position is also shown in phantom lines as a groove 160 located in tip 29, and which at least three holding fingers such as 161 engage radially. The bar shapes, external surfaces and coatings thereof, handles and/or constructions all bear enough similarities not to warrant another description. In FIGS. 6, 7 and 8, for illustration expediency, the bars are shown in a horizontal position already, thus need not be repeated.

FIGS. 11 to 15 depict how the three bars are typically arranged in a horizontal position, relatively to one another, and how they are supported, guided and/or restrained. The bar numbering is kept similar but with a prime index (') for differentiation. Because one or two actuation bars may be used concurrently in this embodiment, bar 22' appears also as bar 22'' if it is substituted for bar 23' in FIG. 10. Only the ends of the bars are shown in solid lines. The mid-portions are shown in phantom lines for which the external profiles or contours outlined in FIGS. 6 to 8 may be substituted. FIG. 10 is in the form of a diagram showing how the bars and ball 20' interact and move.

Bars 22' (or 22'') and 23' may rotate and have one end fixed axially, radially and/or laterally. Their other end is equipped with a handle (not shown) and is allowed to move radially within limits. The handles may be located on the same end, left (L) or right (R), of the apparatus and are then both controlled by the same player, or on different apparatus ends so as to facilitate their separate control by two competing players. Bar 21' ends are free to rotate and adjust vertically as indicated by arrows f' and f'' so as to compensate for variations in distances between bar/ball contact points and the bar longitudinal axes. These contact points are A for bar 21' cross-section 21*, B for bar 22' cross-section 22* and C for bar 23' (or 22'') cross-section 23*. In the most general case, ball 20' is subjected to two opposite pulling forces F1 and F2 (FIG. 11) applied at two points P and Q diametrically opposed, along an axial direction X substantially parallel to the bar longitudinal axes and followed by ball 20' center 0 during the ball travel. Pulling forces F1 and F2 are generated by two spring lines (not shown) emerging from points P' and Q' substantially located at the left end and right end respectively of supporting structure 40, not shown in FIG. 11. When the apparatus is operated by a single player (both handles located at the same apparatus end), the bar external surfaces may be configured so that ball 20' travels from one end of the bars to the other. When the apparatus is operated by two completing players (handles located at opposing ends of the apparatus), the starting point of the ball is generally located half-way between the bar ends. Forces F1 and F2 are then equal and no axially directed friction reactions are present at points A, B and C (equilibrium state). For ease of recognition, the bar shafts and tip ends are numbered in a manner similar to that used in FIGS. 6–8, i.e. 36', 37', 38' and 28', 29' and 30' respectively. The bar shafts and the tip ends are shown located on the same apparatus end for convenience sake, although this may not have been necessarily the case.

FIG. 12 schematic shows how the tip end 29' of bar 22' for instance is restrained axially. A circular V-shaped groove 160 is engaged by pointed fingers such as 161 which cooperate to define a point H located at the intersection of bar 22' axis and section 13—13 plane. Bar 22' is free to rotate and oscillate about point H which is then considered fixed. The same construction applies to one end of bars 23' and 22''. Section 13—13 is shown in FIG. 13 where three fingers 161, 161' and 161'' converge radially toward point H. They are mounted on and positioned by the apparatus end structures. Their stems such as 162 can be threaded to provide adjustment or pushed by compression springs (not indicated, being well known in the art).

FIG. 14 shows a view of one of the two end structures 141 of the apparatus alternate embodiment. These end structures are mounted on main structure 40 and reinforced by braces 41. Each end structure supports three bar ends which are positioned 120 degrees apart. In FIG. 14, the three bars are shown located at a manner such that the guide bar is above the two actuation bars. The adjusting mechanism of the ball recall spring is only schematically shown in dotted lines as index finger 154 having a pin 155 which engages positioning holes such as 156. A spiral leaf spring 157 is attached at one end to axle 158 which is adjustable by means of setting knob 159. Spring 157 housing 167 is supported by end structure 141 and positioned by three dowels such as 163 pressed in structure 141 and engaging three cooperating openings 164 of spring 157 housing 167. Although not seen, the profile outlines of the three bars are indicated in phantom lines for reference. As applicable, the shafts or tip ends of the bars are located in openings such as 165 in structure 141. Line 166 connecting ball 20' to spring 157 is shown entering spring 157 housing 167 through fixed guide hole 168.

FIG. 15 schematically illustrates the manner by which the shaft 37' of bar 21', used as an example here and applicable to any of the other bars, may be spring loaded by spring 170 adjustable by means of screw 171 which sets the resisting force exerted by the spring through short rod 39' against the player's action. The radial travel of shaft 37' may be limited by stop block 172 slidable and positionally adjustable in opening 165 by means of setting pins such as 173 held by end structure 141.

The drawing of FIG. 16 shows a cross-section of recall spiral spring 157 in its housing 167 and located in drum 174 which it actuates and on which line 166 winds up. Ball 20' recall line 166 is guided by pulley 175 rotating on axle 176 supported by end structure 141. If a rubber band is used in lieu of spring 157, attachment 83 mounted on bracket 177 secured by bolt 178, pulley 175 then is not needed. Attachment details of spiral spring 157 to drum 174 are depicted in the partial section shown in FIG. 17. A stub hook 179 protruding off the surface of axle 158 engages an opening 180 in the inner end of spring 157. The outer end of spring 157 is retained by a hook 181 lodged around stop 182 affixed to drum 174 flange 183. Pulling line 166 out or unwinding it from drum 174 causes end 181 of the spiral spring to move in the direction of arrow f, thus increasing the recall torque developed by spring 157. Torque setting corresponds to arrow f'.

FIGS. 18 and 19 shows how the openings 185 and 186 in end structure 141 may be oriented with respect to opening 165 which restrains the guide bar shaft. Prime indices in FIG. 19 are used for differentiation purpose. The meaning and implications of such various positions and orientations of those openings are discussed in the next section in more details.

DISCUSSION AND OPERATION

Understanding the operation principle of the present invention is somewhat more difficult than grasping the basics involved in the two previously cited references. The present invention requires a certain degree of spatial visualizing because the ball is forced to move against gravity, and even enhanced at that, and the ball is coerced (urged) indirectly in doing something which it does not want to do naturally. Thus it is deemed appropriate to first establish and discuss the criteria of the operation principle.

Operation Principle Criteria:

A first basic theoretical criterion is that the three tangent planes passing through points 91, 92 and 93 diverge upwardly so as to form a three-sided pyramid having its apex below the ball, funnel-like. This is automatically realized when the bar surfaces are cones of revolution and if their generatices passing through points 91, 92 and 93 converge below the ball. However, the ball must be caused to rise at great risk of falling back if a challenge, hence the possibility of a game, is to ensue. A second criterion is that means must be provided to create this urge of the ball to rise, by means which act directly on the ball but are indirectly under the control of the operator, hence the compounded quasi-helical surface needed for the actuation bar. Such a surface necessarily must present to the ball a constant and continuous doubly curved surface, the implication being that ball 20 lateral position must constantly and continuously comply so as to insure contacts at the two other contact points 91 and 93. Furthermore, the external surface of at least one other bar offers a non-linear path to the ball, purposely. The consequence thereof is that the variations in angle made by tangent plane at point 93 will in most instances cause the solid angle previously defined to become nil or even negative (planes converging above the ball), at least half of the time. This will cause the ball to fall, falter or descend, unless action is taken by the operator to compensate therefor. Such compensation may be provided in five ways, all relying somewhat on friction, they are: (1) moving the compensation bar (23) inwardly, (2) moving the actuation bar (22) inwardly, (3) rotating either of or both bars 22 and 23 in the correct directions, (4) moving either of or both bars 22 and 23 sideways, and (5) simultaneously moving and rotating either of or both bars in a coordinated and conjugate fashion so as to maintain the three contacts points, so that friction may then be taken advantage of.

A third criterion is that friction is important and must be considered in the form of sliding friction and as being much larger than rolling friction. Sliding friction can be exploited as is demonstrated later and rolling friction can be ignored, in a first approximation. In the following rough mathematical treatment of the problem, all forces interacting between the ball and the bars and excluding friction will be assumed to be horizontal, because they are normal locally to quasi-vertical surfaces (tangent planes at the contact points). Usually, the coefficient of sliding friction can be defined as the tangent of the angle made by a sloping plane on which an object slides down at constant slow speed. In other words, the plane may tilt to an angle whose tangent is equal to the friction coefficient, before the object starts to move. Resting and moving frictions are considered the same here for simplicity sake. In the present application where an object slides against a quasi vertical plane, i.e. locally, it will be assumed that the object does not fall, if pushed against that plane by a force F to counteract its weight, until and unless the plane forms a "negative" angle with respect to the vertical, the tangent of which is slightly larger than the angle expressed in radians which represents the friction coefficient. In the present case, as is the case for small angles, angle and tangent are assumed to be equal.

Thus, if one assumes that ball 20 is still and in static equilibrium between the three planes and one bar is constrained outwardly by a spring, so that enough compliance is provided, three equal forces F are inwardly and radially exerted on the ball at points 91, 92 and 93 (FIG. 10). Assuming that the three planes equally and simultaneously starting from a vertical position begin slowly to tilt so as to make their intersecting lines converge at a point located above the ball, the converging point (pyramid apex) gets closer to the ball and at one point ball 20 slips and falls. In such a simplified case, one can calculate the angle made by any of the three planes with respect to a vertical reference line, if one assumes that forces F were only large enough to counteract the influence of gravity on the ball of weight W. At the equilibrium condition (onset of ball slippage), F, W and the friction coefficient expressed in radians $\delta\phi$ are related as follows: $W=3F\cdot\delta\phi$(1). Equation (1) permits to calculate F which is $W/3\delta\phi$. It must be noted here that increasing F will not prevent the ball from falling for reasons which those readers familiar with the art well know. $\delta\phi$ represents the effective combined coefficient of the sliding friction taking place at any instant at the bar/ball interface. It is of course function of each surface friction coefficient.

A fourth operational criterion is that maneuvering control of the actuation bar should never be lost by the operator, unless it is by design in the case of some games intended for experienced players. This means that the whole surface of bar 22 should be coated with a material having a high $\delta\phi$, or the bar material may exhibit such friction characteristic. In such instance, a player is always able to impose a rotation motion onto ball 20 and the ball will be prevented from sliding down if proper lateral force control is concurrently applied by the operator.

Operation Principle Analysis:

Having established the criteria to be met by a bar/ball system to operate theoretically satisfactorily, it remains to determine a set of design parameters and their variation limitations so that at least one continuous ball path upward along bar 22 surface is provided by the system in the case of the most difficult combination of said parameters and variations thereof. Thus these parameters should first be defined in the case of a free ball, i.e. without spring 81 recall feature. They are also defined in the most general case where the bar average cross-section diameter D varies lengthwise. These parameters are also non-dimensionally defined, except for angles which have no dimension by definition. They are:

$\alpha$—average pitch angle of the base helix (curve 62)

$\beta^*$—maximum "swing" angle permitted to bars 22 and 23 ($\beta^*<\beta$)

$\gamma$—slope angle presented by a bar diameter variation $\theta^*$—maximum angular adjustment of conical holes in base 34

$\Delta\theta$—sideway angular adjustment imposed by a player

R*—maximum radial adjustment of conical holes in base 34

ΔR—radial (lateral) adjustment of a handle (player imposed)

Z—upward vertical travel of the ball

L—length of any bar (i.e. distance from base 34 to top 39)

d=D-value variation caused by any bar cross-section change

Γ—amount of rotation imposed on bar 22 by a player during a game

Ω—amount of rotation forced upon ball 20 during a game

D/L—diameter/length ratio, kept fixed for practical reasons d/D—measure of difficulty caused by a rapid diameter change D1—bar reference diameter at the bottom end D2—bar reference diameter at the top end Δ—ball diameter (ball assumed to be spherical)

δ—ball diameter variation (non-spherical ball)

δ/Δ—measure of the non-sphericity of ball 20

∂—average diameter of the base helix (curve 62)

Z/Ω—measure of actuation bar 22 ability to urge the ball up.

Additional operational combinations are possible and involve two other parameter and variations thereof. They pertain to the guide bar (21) external surface and the ball recall spring loading that increases the actual weight of the ball and may render it variable during a ball ascension. The variable ball weight is referred to as W* and is equal to (W+Fz), where Fz may be defined as (K+kZ) if a linear spring is used. K represents the initial loading, if any, and k is the spring stiffness (dFz/dZ). These additional parameters provide adjustment and/or response variations which are:

W*/Z—measure of the increase in rising difficulty of ball 20 as a function of the height level reached at any time Xz—distance between point 91 and guide bar 21 longitudinal axis at level or height Z (amount travelled by ball 20)

Ψ—angular position of a reference generatrix of guide bar 21 with respect to a reference position ρ (FIG. 3)

dW*/dΩ—measure of the degree of coupling between the ball recall force and the amount of ball rotation.

As one can easily see, a very large number of combinations, permutations, and associations thereof of design parameters and variations thereof are possible. Such combinations, permutations and associations thereof cannot be discussed here and are left to readers familiar with the art to select. Suffices it to say that a continuous path for ball 20 to follow along the external surface of bar 22 must exist for which the following "no-falter" condition for ball 20 is always satisfied: at no time must the solid angle formed by the three tangent planes reach and/or fall below a critical value defined as $-\Sigma\delta\phi$. The minus sign indicates that the planes may slightly converge at a point located way up above the ball, because of friction as earlier mentioned. The plus sign will indicate that the planes diverge upwardly and the ball is in an absolutely stable position.

At this juncture, it is noted that the following simplifying assumptions are made: (1) the solid angle made by the three planes is the sum of the angles made by each plane with a vertical reference line such as axis 0, positive if the plane diverges upwardly from axis 0, (2) the solid angle formed by the three planes varies approximately as the sum of the variations of each plane angle just defined, and (3) the influence of bar swinging, tilting and/or lateral/sideway displacements on any solid angle so formed at any time is negligible as long as the ball height does not vary and no rotational motion takes place, of the ball and of the bars, during such coordinated swinging motion of the ball/three-bar assembly. With such assumptions, the critical value $\Sigma\delta\phi$ can now be written simply as: $\Sigma\delta\phi=\delta\phi'+\delta\phi''+\delta\phi^*$ (3). In equation (3), $\delta\phi'$ and $\delta\phi''$ represent the effective combined instantaneous friction coefficients of bars 21 and 23 with ball 20, respectively. $\delta\phi^*$ represents the actuating instantaneous coefficient of friction between bar 22 and ball 20 surfaces. The ball "no-falter" or "no-fall" criterion used by the players will be satisfied as long as a player can successively continuously maintain and maneuver the ball in a position relative to the bar surfaces from which he (she) will cause the instantaneous value of the solid angle to remain higher than $-\Sigma\delta\phi$, if forces F are constantly exerted on the ball. If not, whenever the forces fall below a critical value, the ball will falter unless the solid angle has a positive value (rest period for the player).

The critical value of forces F remains constant if W* remains constant also and if $\Sigma\delta\phi$, expressing then the total amount of friction, does not suddenly decrease. If it does, a then-converging solid angle had better decrease also concurrently by the same amount and preferably more. The basis for the formulation of a mathematical model of the system has now been established. Such formulation, however, is beyond the scope of this disclosure but the complex mathematical problem now defined can easily be solved by means of state-of-the-art computing techniques and facilities. A less esoteric approach could be used, whereby the "twisted" surface of actuation bar 22 is first determined and for which values of tangent plane angles can be calculated for each cross-section and each point of the cross-section contour circle. The bar surface coefficient of friction can be established. For a given surface of ball 20 and coating material, a resultant tangent plane angle can then be calculated for each point of bar 22 surface. For given combined coefficients of friction of the other two bar surfaces, the sum of the two tangent plane angles contributed by those two bars may then be determined. At this juncture, the designer is left with the choice of allocating a set portion thereof to each bar and proceeding gradually as explained for bar 22. A first "cut" is to assume a conical surface of revolution for bar 21 and a constant coefficient of friction therefor. The surface contour of bar 23 then may be determined. The variations of its surface coefficient of friction (i.e. band 72 or 73) can be taken into account at that time. The bar configurations shown in FIGS. 7, 8 and 6 reflect this type of design approach.

It is believed that the above discussion demonstrates that a plurality of ball paths can be provided by the proposed system approach to solving a complex problem simply, albeit necessarily in a lengthy manner. The use of computers for solving the formulated mathematical problem will enable the designer to determine first an ideal optimum single solution (single path) and then by backing-off from this single solution determine a band of possible paths which renders the game more easily playable.

Configuration and Construction Design Trade-offs:

The logical approach to designing system configurations and constructions of the present invention which present increasing difficulties is to start with the simplest configuration and progressively add or change one construction feature at a time for introducing one new type of obstacle. However, there are some basic construction features which must be discussed now and preselected as starting points for any basic embodiment. One is the segmentation of bars 21 and 23, another is the use of spring restraining of bar 23 and still another is the use of a spring recall system for ball 20. Also, it has so far been presumed that the bar general shape is slightly conical, with the bar cross-sections generally increasing from bottom to top. It can just as well be the other way around, where the bar cone is inverted and the bar cross-section generally decreases from bottom to top. In the latter case, the radial distances of holes 31, 32 and 33 to axis 0 must be increased accordingly, whereas the dimensions of openings 43, 44 and 45 must also be adjusted accordingly. An additional set of conical holes can be provided in base 34 to that effect, hole 42 needs only be a little smaller so as to accommodate such a reversal in the bar cone orientation. Furthermore, the cylindrical walls of tips 28, 29 and 30 can be threaded for use as screws to fit in handles 27, 24 and 25 respectively. Vice versa, the ends of screws 67 can be made hemispherical so as to fit in the bottoms of conical holes 31, 32 and 33. The bars may also be cylindrical. They can be mixed and grouped in a way such that at least one bar has a general shape of one type whilst the others have a general shape of the other type. The conically shaped bar(s) may be oriented upwardly or downwardly, provided that their tips and shafts are properly positioned inwardly. All these combinations, permutations and associations thereof may also be associated with others described and discussed herein.

Bar Segmentation:

The inertia and the friction resistance presented by the mass of a whole bar to rotation, i.e. 21 and 23, may at times be such that the torque needed from the bar contact points with the ball exceeds the friction torque which bar 22 can possibly transmit to ball 20. In such case, ball 20 does not turn and its maneuvering, hence control, becomes impossible, i.e. it will not rise. Such occasional occurrence may and will happen by design as one of the obstacles that a player has to contend with, however it cannot be the rule and happen accidentally when it should not. To avoid such unwanted occurrences and prevent unprogrammed difficulties, it is preferable to insure that both inertia and friction forces and torques resulting therefrom are minimized. This can easily be done by structurally isolating a small mass element of the bar body from the remnant of the bar. Thus, most of the bar weight is divided into light segments which are free to rotate separately when a minimal torque is applied thereto. The segments are positioned and supported by stems 66 that provide the bar rigidity and are coated with a low friction material so as to facilitate the segment rotation thereon. The faces of the segments resting on an another adjacent segment or flange face are also coated with a low friction material.

With such construction provisions, the normal sliding friction force exerted at point 91 or 93 is large enough to generate the torque required to rotate one single segment. If an obstacle is wanted by design, a portion of the segment outer surface may be coated with a low friction material and/or two or more segments can be joined together by a pin such as 65. It is believed that the segmentation of actuation bar 22 would be unproductive. It is conceivable that only one of the two bars 21 and 23 needs be segmented so as to provide more advanced game opportunities to experienced players. In either event, bar segmentation represents a basic design trade-off which is almost mandatory if variations of bar 21 and/or 23 external surfaces are to be spot-coated with low friction coefficient materials.

Bar Spring-Restraint Construction:

Although a game may be played by two or three players simultaneously against one another as later discussed, at least during the learning and familiarization period, games will be played by one single player against the odds of succeeding in causing the ball to rise to the top. A witnessing player may act as a challenger but then cannot interfere with the operator's ball maneuvering. Either as an aid or as a built-in challenging difficulty, a trade-off construction feature allows the player to play with either hand on handle 24, the other hand remaining free, which may be useful during the learning phase. The resistance to inward motion of shaft 37 is then provided by spring-loaded sliding rod 77 which constantly urges either bar 23 or 21 (or both) to move inwardly and push ball 20 against bar 22 which the player is controlling. As earlier mentioned, bar 21 may be fixed during a game but may also be rendered compliant by such means. Conversely, bar 23 may be fixed, letting bar 23 play the role of a guide bar. Of course, both bars may be spring loaded, with the proviso that the spring force is set to vary appreciably with the amount of compression so as to cooperate together in attempting to maintain ball 20 centered, i.e. aligned along axis 0. In such an instance, shaft 37 should be granted an additional degree of freedom such as being enabled to move sideways as well as laterally inwardly-outwardly. Such sideway displacements are facilitated, albeit limited to some extent by opening 44 enlargements such as 100 and 101 shown in FIG. 3. Sideway enlargements 102 and 103 of opening 45 are needed only if and when bar 23 is controlled by the player's second hand. Sideway enlargements 104 and 105 of opening 43 are used when guide bar 21 is fixed and provides the means for adjusting the setting of shaft 36, hence of the track which ball 20 is then obligated to follow, though slanting sideways.

Ball Recall-Spring Construction:

The incorporation of this design feature in the construction of an alternate invention embodiment is perhaps the most basic of the trade-offs mentioned earlier, for it affects the ball response the most. Its presence has two main effects: (1) it precludes ball 20 from substantially rotating about any axis which appreciably deviates from axis 0, for line 81 and its attachment 82 would then interfere with the bar external surfaces, and (2) the down pull exerted by the spring substantially affects the ability of the ball/bar contacts to provide the previously noted degree of bar/ball interactions. The third effect previously mentioned caused by a coupling action, which a rubber band best provides, between the ball rise and any rotation resulting therefrom combines with the first main effect in a manner which can be exploited by an experienced player. This can advantageously be utilized by such player in attempting to maximize the ball rise-to-rotation ratio, which then minimizes the pulling down force of a rubber band.

The end results is either a greatly increasing degree of difficulty with any set of bars, the use of which presents a player with a new challenge, or a redesigned set of bars. In this construction, the ball CG-position and weight adjustments become somewhat moot because non-axial rotations of ball 20 become necessarily limited, which negates either the use of or most of the challenge features offered by such adjusting flexibility. In any event, the incorporation and use of this construction trade-off offers another great opportunity for greatly expanding the challenge presented to and the ingenuity of the player. The effects that a construction incorporation of this type has on the conceptual design of the invention basic embodiment clearly make it a trade-off alternate embodiment of the present invention, because of other constructions features which must either be given up or appreciably modified.

Ball Motion Modes and Amplitudes:

Although the ball motion inducement and responses thereto are discussed above, it is of interest to indicate typical sizes and dimensions for the ball, the bars and various adjustments. A typical height for the apparatus could vary between two feet (desk or table top unit) to four feet (floor standing size) or more. A size variation by a factor of two between models may then be envisaged. Thus, dimension ratios are used hereafter to relate typical dimensions of one member to those of another. An attempt has been made to use dimensions in the drawings which have approximately the correct relationships. These may be used as a guide.

As a general rule, dimensions ultimately relate between themselves by means of angles. It was earlier shown that angles play an important role in the present invention because friction is a keystone in any embodiment architecture, and can best be translated in the form of angles. Another factor to consider is the ability of the human hand and fingers to impose a continuous angular movement to a handle either without having to let go or being enabled to readjust the position of the hand and/or of the fingers.

Friction Coefficients:

First a distinction must be made between static friction and sliding friction, the former being usually higher than the latter, everything else being equal. For simplicity sake, coefficients of sliding friction are contemplated here. Incidentally, the higher corresponding static friction coefficients facilitate the readjusting of the players fingers on a handle, while the ball is held still, which would be close to impossible, if it were not for this peculiarity of friction. Practically, extreme values of 0.1 (roughly 6 degrees) to 0.4 (roughly 23.5 degrees) represent a good range for variations of sliding friction coefficients and the corresponding slide angles. Depending on materials, the ratio of static to sliding friction coefficients could vary from 1.3 to 2.0, which represents both a comfortable leeway for players and enough variation therebetween to create an additional built-in guessing challenge and which depends on the segment material and/or nature of the coating thereupon. It is thus obvious that: (1) angular adjustments of the bar are not as critical as would appear at first glance, and (2) game playing is not as difficult as it may so far have seemed, unless designed to be so.

Another factor is worth mentioning, it relates to the amount of punctual deformations which either the ball or bar surfaces, or both, may intentionally be allowed to assume. Rubber-like materials will provide a considerable amount of deformation at the bar/ball contact points, whereas hard plastic on hard plastic materials will not. The amount of punctual deformation thus permitted may then be taken into account in the design formulation for specific levels of player proficiency.

Ball Rotation-Travel Limitations: p These limitations are related to design parameters and to application practicability. Design parameters have earlier been defined. The practicability of a typical invention embodiment has not yet been mentioned, it involves physical limitations that are imposed by nature on the normal ability of the arm, wrist and fingers to operate cooperatingly to produce a coordinated linear horizontal motion and rotation around an axis orthogonal to the motion direction. The linear motion may be absent, but a corresponding controlled force must then be applied in the direction that the motion would have taken if no displacement constraint had been imposed, which may even be more difficult for a hand to contend with or to provide in a constant and continuous fashion.

At the same time a force and/or motion of the arm/hand/wrist/fingers are applied, the magnitudes and/or amounts of variations thereof must also be simultaneously controlled. The handle diameter must typically be of the order of one inch, maybe $\frac{3}{4}$ of an inch for a child. The magnitude of the forces involved is small, their variations are necessarily small also. The rising speed of the ball must be low enough to permit good visual observation of its upward movement and of its faltering or brief descent, which represents the only practical criterion for failure in the forms of competitive game played by ordinary players. This means that the ball should not rotate fast, certainly more slowly than the actuation bar. Thus the mean diameter of bar 22 should be between half and one third of ball 20 diameter. The other two bar diameters could vary considerably more.

As the ball rotates, it is urged to rise as previously described, and in doing so it encounters the obstacles presented by friction changes and the variations in solid angle $\Sigma\delta\phi$. These angle variations must neither be too large nor happen too suddenly, albeit occurring at a rate fast enough to present a meaningful challenge. There is no relationship between the frequency or length of the "waves" contoured on bar 22 surface and those that are depicted as "swellings" on bar 23. However, there is a relationship, and rather well defined, between the length or frequency and the amplitude of bar 23 local diameter swelling. Such swelling characterized by d/D determines the maximum angle variation of $\delta\phi$ which the player will have to contend with by maneuvering ball 20 accordingly. Approximate upper limits of the lengths and amplitudes of such typical swelling waves are shown in FIG. 6. It is assumed, that it should be intuitively obvious to a reader familiar with the art, that the radius of curvature of a wave depression (e.g. at point 71) should not be smaller than the ball radius. For bar 23 of FIG. 6, this means that practically such length and amplitude limitations will correspond to three times as many swellings and depressions as depicted in FIG. 6. Though this number could easily be two or three times larger, by means of a decrease of D, lateral adjustments of handle 24 would become too frequent, although this would represent a higher degree of proficiency requirement. Fabrication tolerances and the amounts of clearances required between stem 66 and the internal diameter of the segments, and the amount of tolerable lateral flexibility of bars 21 and 23 also dictate a practical minimum value for D.

Identification and Classification of Obstacles and Challanges:

As the reader is well aware of now, the object or purpose of the present invention is to offer to players difficulties of increasing magnitude which must be overcome for a player to win a game or achieve a higher score. This occurs when the player has urged the ball to the top without noticeable receding in the ball ascent happening at any time during the ball rise. The aim of a competing player or of the apparatus construction is to create obstacles presenting increasing challenges along the upward paths of the ball. The nature of all obstacles is such that at any and all instants the ball is solicited to stop and turn back downward because the sum total of the forces acting thereupon reverses its direction, from upwardly to downwardly. In order to challenge the player's skill and/or experience, an element of surprise must be incorporated so as to remove anticipative preparation of the operator, e.g. sudden change of surface friction coefficient(s) at one or more ball/bar contact point(s). The various types of obstacles and the kinds of player's responses thereto are listed below in Table A, in a summary form.

TABLE A

| OBSTACLES AND PLAYER'S RESPONSES THERETO | | | |
|---|---|---|---|
| OBSTACLE | SUBJECT MEMBER | SURPRISE ELEMENT | PLAYER'S ACTIONS |
| Slope Change | Bars primarily Ball (rarely) | Practically none Some (e.g. hidden) | Anticipation and Planning therefor |
| Friction Change | Bars and Ball equally | Can be sudden and compounded | Keeping Ball in a favorable position |
| Bar Inertia Change | Bars only (segments) | Can be sudden and combined with $\delta\phi$ | Placing Ball in a favorable position |
| Ball CG, Weight | Ball only | None | Planning and Preparation therefor |
| Ball/Spring | Ball only | None | Planning and Preparation therefor |
| Bar Inversion | Bars(s) only | Same as above (adjust bar ends) | Adaptation to Bar re-orientation |
| Bar Locking | Bars(s) only | Effects of $\delta\phi$ changes enhanced | Game Planning by proficient Player |

Remarks on Table A contents:

1. The non-sphericity of ball 20 is not directly mentioned except as "(rarely)", this also includes the insertion of local "bumps" such as 74 and 75 shown in FIG. 6 for bar 23; 2. the word obstacle also has the connotation of "difficulty created thereby"; 3. $\delta\phi$ here and elsewhere when not used directly in connection with friction, refers to a slope variation either local or more general such as "swelling" of cross-sections of a bar; 4. all obstacles have been described and discussed previously and should be identifiable by the readers; and 5. all classes of obstacles can be combined with one another and varied in magnitude intentionally and hopefully never accidentally so that an experienced player may plan game strategies.

It is evident that the types and numbers of challenges presented by the invention embodiment are very varied and demand an understanding of some basic laws of physic and/or mechanics, and if not, a large degree of learning and experimenting. For instance, sudden changes in type and amount of friction of the ball and/or bar surfaces may be created by construction features such as local bumps 74 and 75 or the insertion of wide rubber bands such as 110 or 112 in an accommodating lodging recess located between two adjacent segments, to avoid sudden raises or depressions in the bar external surface at interfaces such as I. Rubber provides both a brusque variation of friction coefficient and a change in structural support compliance to the ball pressure. Rubber bands 110 or 112 are self supporting and locking. They also easily conform to changes in bar surface curvature in a longitudinal direction. Local bumps 74 and 75 do not however, unless retained by an adhesive coating. Another attachment method is to provide the adhering bump surface with small protruding pins such as 111 which fit inside small cooperating cavities located in the bar or segment structures. The size of such cavities must be small enough so as not to interfere with the ball rolling when the bumps are removed, although short protruding pins may be inserted instead so as to create local barriers intended for an experienced player to avoid, thus creating another obstacle and challenge. Such bumps and/or rubber bands extending around great circles on the ball surface can also be used to affect the ball response and behavior in a similar manner.

Readers understand that configuration changes such as bar inversion require special provisions already prebuilt into the apparatus structure. In FIG. 2, such prebuilt provisions are depicted in the form of small circles 113, 114, 115 and 116 which correspond to bar tip repositioning. Location of circle 116 for instance corresponds to repositioning of tip 28 of bar 21 when its larger diameter end is located near base 34, its handle 27 being then relocated at the other end (small diameter cross-section), as earlier noted. Also provisions must be made for filling up recesses needed for the positioning of rubber bands such as 110 and 112. This can be done by means of segments having slightly smaller diameters and replacing them with regular sized segments. In the case of the ball, the rubber band may be replaced by a split plastic ring dimensioned to fit snugly in the recess provided for the rubber band placement.

Finally, guide bar 21 can have a non-circular flat track 120 as shown in FIG. 8 which extends between the bar two ends, in which case bar 21 is solid and not segmented. Ball 20 is thus forced to slide against the track surface. Longitudinally, the track needs not be straight but can also present an undulating profile to ball 20 on its way upward. The same solid bar 21 may also provide an assortment of such flat tracks arranged around the bar cross-section so as to enable players to select and set up different degrees of difficulty and challenge. The bar is locked in place by a set screw pressing on shaft 36, as is well known in the art, thus not shown here, so as to fix track 120 position.

Types of Games and Corresponding Apparatus Configurations:

As earlier mentioned, different types of games and associated challenges require different arrangements, textures and/or shapes of the four member surfaces. The challenges are summarized and listed in Table A, in the form of obstacles to be overcome. The reader may thus imagine other variations not mentioned and ways to combine them to create games. Their number is almost practically infinite. Discussion of such game variations is not warranted here. The word game, as used here, applies only to the manner by which one player can use the apparatus or at least two more players may play against each other, using the apparatus as a tool for skill measuring and/or scoring.

Single Player Games:

In this apparatus use, only one player interacts with the apparatus at one time. One or two hands may be used by means of handles 24 or 24 and 25. A ball configuration and three bar arrangements/configurations are used in a fixed combination for a game. The playing operator either plays for his (her) own sake and either keeps score for skill-improving or plays against other players who in turn will be given an opportunity to demonstrate and score their skills. A scoring point system can be devised so as to record the comparative scores. Non-playing players may act as observers and witnesses, but are not allowed to interfere with any physical aspect of the apparatus and/or its support. A scale for scoring may be established depending on the degree of difficulty which a set bar/ball arrangement and configuration offers. The number of players is not limited because each one of them plays in turn. A handicap system may also be established so that players having reached different skill levels can still play together competitively, as is done in golf.

Two-player Games:

Again, this type of game may be played one-on-one in a competitive fashion, or as a team against other teams. In the one-on-one mode, the total number of players may be even or odd. In the team mode, the number of players must be even. The manner in which the game is played in a one-on-one fashion is totally different from the manner in which a team of two players play together.

In a one-on-one game, the object of the game is to enable a first player to urge the ball upwardly whereas the second player attempts to prevent the first player from achieving a high score by causing the ball to falter and noticeably move downwardly. In this game, the first player controls handle 24 and the actuation bar, and the second player controls handle 25 rotation and thus the degree and type of difficulty that the ball, hence the first player, will encounter. Here, handle 25 and bar 23 positions are laterally fixed so as to prevent the second player from suddenly relieving the balancing pressure on ball 20, which must be maintained at all times, lest the ball be permitted to free fall.

In a team game, the object of the game is to enable both players to cooperate in urging ball 20 upwardly. One player handles actuation bar 22 and the other player handles bar 23. Each player is thus enabled to use his (her) best hand and fingers. The team may play one game and then exchange roles, one player acting as prime ball mover and the other player acting as facilitator. Scoring and score record keeping may be done by the other team(s) of players waiting for their turn. It is obvious from the above that the playing techniques and strategies to be used are then entirely different from those which the players must follow in a one-in-one competition game.

Three-player Games:

Because of the distinctive special nature of the role played by each bar and the fact that it would be very difficult to determine unequivocally the responsibility or contribution of each player to either success or failure, a single player must either reap the fruits of success or pay for failing. The simplest mode of game implementation is to pitch the operator of the actuator bar against the team formed by the two other players, one monitoring bar 23 and the other controlling bar 21 which is then not fixed. The two-player team thus combines and coordinates its efforts so as to maximize the degree of difficulty which the third scoring player must overcome. The latter tries to obtain the highest score whilst his opponents attempt to prevent this. Only one player scores per game, other players may thus be regarded as obstacle or challenge makers, and/or witnesses. Players take turn in acting as scorers and challenge monitors.

Scoring Features:

Two aspects of scoring are important: (1) its correctness; and (2) its undisputability. Because of human nature, the second factor gains in importance as the first factor looses in ease of detection and/or reading. This introduces a time element which technological developments have attempted to eliminate by shifting from analog-type of information display to digital-type. An attempt is made here, as earlier mentioned, to minimize the importance of the time element by means of small shallow circular grooves 60 on the external surface of bar 21. Such grooves enable players to arrest ball 20 at an easily identifiable level so that score reading becomes undisputable and unequivaocal. Only an action on the part of the operator of actuation bar 22 can urge the ball out of a groove in which it has temporarily lodged. The scoring player thus is in control of the time element, either to settle a scoring dispute or rest a while. Such rest grooves can be located on flat tracks 120 to the same effect.

In the case of some games, grooves 120 may prove to have detrimental effects, e.g. in a two-player one-on-one game. For such game playing, the external surface of bar 21 should remain free of angular ridges, no matter how small, and still provide means for score indication. This can be done by the presence of narrow circular colored bands such as 121 located at various intervals between bar 21 two ends. Such bands may also display numbers and/or letters for indicating a level and a score.

Materials and Construction:

The construction of each member of the apparatus is rather simple and straightforward. No dynamic loads and/or effects of or on moving parts are developed during each playing. The nature of the difficulties to be overcome by players demands skill, but applied slowly and carefully. The magnitudes of all forces involved in causing motion are low. The general operation requirement thus pertains more to statics than to dynamics. Inertial forces enter into play only if and when momentary angular acceleration of bar 23 and/or bar 21 is needed, which a good experienced player would avoid. Solid bars will normally be rigid enough. However, segmented bars are structurally less rigid, albeit requiring to be more rigid because of the influence which bar bending could have on the rotational freedom which individual segments must have. Stem 66 could thus best be made with steel tubing and coated externally to provide low friction. Individual segments can then be made of hard plastic coated to provide the degree of friction locally required, i.e. low on the wall of the internal bore and the flat end faces, as needed on the external surfaces.

The clearances between the segments and the stem, and between themselves, must be small enough so as to prevent sizable discontinuities and gaps between the external surfaces of two contiguous segments. It is believed that a few thousandths of an inch will be acceptable. Diameter clearances between stem 66 outside diameter and a segment bore diameter can easily be realized with current fabrication techniques to that effect.

The distances between segment faces can also easily be controlled in plastic molded parts within one or two thousandths of an inch. Tolerance stack-up will leave a certain amount of play at the top of the segment stack, between the top segment upper face and flange 69, which is unimportant, thus quite acceptable.

The positioning of holes such as 31, 32, 33, 113, 114, 115 and/or 116, of openings such as 43, 44, 45, 101, 102, 103, 104 and/or 105 is not critical. The dimensioning of the bar outside diameters is not critical either, because slopes and variations thereof are more important, and can easily be avoided by any manufacturing state-of-the-art process. The only member left to consider is the ball which is discussed below.

Spherical and non-spherical balls can be produced easily enough, however ball 20 must consist of two assembled parts if provisions are to be made for CG and weight adjustments. Only the fabrication of a split ball needs be discussed. Although ball 20 surface should be hard and rigid, the interior material could be much less rigid and/or have low compression strength so as to be light, e.g. plastic rigid foam. Also for practical reasons and durability, because of frequent diassembling and reassembling operations to which the ball may be subjected, the flat joint surfaces of each quasi-half ball should be hard and rigid, as well as the walls of positioning pin 50 and ballast weight housings or lodgings. The positioning and dimensioning of weight lodgings 48 is not critical and minor rattling of the ballast is acceptable. However, fitting of pins 49 must be tight to keep the two halves assembled. The positioning of the pin holes must be within one or two thousandths of an inch to avoid unacceptable discontinuities in the ball surface. This is possible with hard plastic moldings. The pins should be standard size and thus made readily available. Molding a hard shell around a closed-cell rigid plastic foam is state-of-the-art. It is also possible to mold a flat hard plastic interface and a rubbery softer spherical shell on the curved external surface of each half-sphere in two separate operations.

The ballast weights could be standard size steel balls, also readily available. These balls should however remain free inside their lodgings, so that they can easily be removed when needed. Mounting of attachment appendage 82 should cause no difficulty if a small threaded bore is molded into the quasi-half sphere, so that attachment 82 can also be easily removed as required, leaving only an acceptable open small hole on the ball surface.

ALTERNATE EMBODIMENT OF THE INVENTION

In the foregoing, the normal attitude of the apparatus has been assumed to be vertical so as to urge ball 20 to move upwardly when so forced by bar 22 actuating. In so doing, ball 20 weight is the action which opposes the end results of such urging, namely the rise of the ball. It was also mentioned that the importance of the "restoring" or recall force provided by such weight could be modified by ballast, but also rendered variable by a "recall" spring action. The latter is hereinafter called restoring action or force. At some point during the ball rise, its magnitude may well exceed or be made to exceed the ball weight. Furthermore, a coupling action between ball linear and rotational displacements can be exploited by the presence of such a spring, so as to introduce an element already described, i.e. an apparent weight increase. The interaction of the ball with the bars and the operation thereof are similar to those discussed in the case of the preferred embodiment and need not be repeated a second time. The major apparatus operation differences stem from the following factors: (1) bar weights immaterial before, except for the inertia aspect, are now important, (2) the ball weight is almost negligible compared to the bar (segmented or not) weights, (3) the importance of the bar weights should and can be utilized to vary the degree of challenge, (4) both ends of the apparatus are concurrently accessible to players, and (5) the ball starting point may correspond to two distinct locations along the bars.

Based on the discussion of the preferred embodiment and the description of the alternate embodiment, the reader understands the object of any game played with an alternate embodiment. This object is to urge the ball to travel from its starting point as far as possible along the bars. To that effect, the ball must be caused to both resist efforts made by the restoration force to oppose such travel and overcome them constantly and continuously. Such resisting and overcoming efforts must be exerted not only in competition with recall efforts from the spring but also in spite of efforts applied by another player, in the most general case. Thus here, the nature of the games which can be played is discussed first, urging the general knowledge already obtained.

Nature and Types of Games:

To simplify this discussion, two basic assumptions need first be made: (1) two bar handles are located on the same apparatus end and the ball is urged to travel from one end of the bars to the other, and the game is played by one single operator, and (2) one bar handle is located at each one of the apparatus two ends and the ball is urged by two competing players to travel as far as possible from a bar mid-way starting point either closer or further away from a designated player (or apparatus end). In the case of the first assumption, one actuation bar such as 22 (22') provides the urging action and the other bar 23 (23') provides the challenging and facilitating features previously described, guide bar 21 (21') provides either support for ball 20' and the two other bars (case of FIG. 19) or maintains the ball in firm constant contact with the two other bars (case of FIG. 19). In any event, however, the player is enabled to vary and adjust the degree of firmness of such contacts by means of radial displacements imposed on bars 22' and 23' handles.

In the case of the second assumption, one actuation bar 22' or two actuation bars 22' and 22'' may be used in opposition, one by a first player and the other by a second competing player. If only one actuation bar, e.g. 22', is used, the other bar could be 23' but having its handle located at the apparatus second end. A handle, that of bar 22' is then located at the apparatus first end. In the game configuration utilizing bars 22' and 22'', each player attempts to urge the ball in a preferential direction and away from its starting point. In such instance, the magnitude of the restoring force and variation rates thereof are not of prime importance, and the ball starting point is mid-way between the bar ends for reasons of symmetry. In the game configuration utilizing bars 22' and 23', a player attempts to urge the ball in a given direction using bar 22' and the other player attempts to prevent such urging by means of bar 23'. The restoring force magnitude and the variation rates thereof are then more important because they constitute the basic challenging feature to be overcome by the player in control of the actuation bar. Because of the inherent lack of symmetry in the game configuration, such a game can best be played in a sequence of two games, for which the roles assumed by the two players are inverted, so as to create the game symmetry that inherently exists when two actuation bars are used simultaneously and the ball is started at mid-way point.

The brief description of the nature and types of competitive games which can be be played by this alternate invention embodiment points out differences which must exist in bar external surface contours and profiles according to the game nature contemplated. For instance, it can be intuitively felt that two actuation bars operating in opposition could easily create a ball/bar interactive situation wherein the ball is blocked and physically prevented from moving in a set direction, thus creating an impasse. This is not the object of the game, could become very frustrating and is to be avoided. The following discusses design ways and construction means for preventing such undesirable occurences.

Bar/Ball Compliance Features:

Physical compliance must then be constantly and continuously provided between the four surfaces that control the interactions between the three bars and the ball so that the three tangent planes previously defined can never converge ahead of the ball along its path in a preferred travel direction. This requirement is described by a bar/ball situational example in which two actuation bars are used simultaneously and when the maximum diameter of circle inscribing triangle ABC of FIG. 11 could become smaller than ball 20' diameter, assuming that all bar shafts have reached the end of their available radial outward excursions. This means that one player would have to allow the ball to back track, thus losing the game or giving up some advantage. If not, the impasse mentioned earlier has been reached. If this is to be avoided, the construction conditions must be such that: (1) enough radial travel is provided for each bar shaft in openings such as 165 to accommodate the passing of the ball through the three bars between starting point and bar ends, or (2) the sum total of all possible increases in distances from any point on all bar external surfaces to the bar longitudinal axes remains below a given amount, said amount varying along the bar length so as to compensate for the bar oscillating motion about its fixed point H.

The last part of conditions (2) does not apply to bar 21' if it is held by two shafts, each one being spring-mounted as shown in FIG. 15. In such instance, an opening 165 is present at both bar ends and bar 21' will both partially oscillate and slide to accommodate any radial compliance demanded of it. The ratio between the degree of compliance provided by bar oscillation and bar shaft sliding will depend on the position of the ball along the length of bar 21', assuming that both springs 170 are adjusted identically. For the sake of expediency, FIG. 15 schematic represents a typical spring-loaded shaft support usable for any of the three bar shafts, hence the lack of numbering consistency.

The type of compliance discussed so far pertains to a physical compliance based on mechanical non-interference. Another type of compliance needs be mentioned, that which pertains to the loads exerted by springs 170 on their respective bar shafts. The stiffness and initial load of each spring 170 can be made variable in predetermined manners. The stiffness may be altered by installing a different spring, the initial spring load may be adjusted by means of screw 171. Furthermore, each one of spring-170 assemblies 190, one for each bars 22' and 22'' (or 23') and two for bar 21', can be set differently so that the shafts of bars 22' and 22'' (or 23') reach the ends of their allowable radial displacements before the two shafts of bar 21' reach theirs. This means that each one of the player may exert an additional inwardly directed force by means of the bar being controlled. Such additional loads are transmitted to bar 21' and distributed between its two ends, balancing one another against the reactions of its two springs 170. The reader will understand that guide bar 21' ends up being generally gently sloping in one direction or the other. The slope of the bar depends upon the combination of the relative stiffnesses of all springs 170 and on ball 21' position lengthwise on the bars. The amount of bar 21' sloping which the relative stiffnesses of springs 170 allow represents a measure of the degree of the second-type compliance mentioned above. It may be adjusted to provide the extra outward radial displacement of bar 21' which is needed to prevent the mechanical interference also mentioned above, while providing an additional difficulty and an additional challenge thereby.

In two-competing-player games, especially if both players use an actuation bar, the criterion used for game winning in the case of the preferred embodiment is not conducive to "fun" entertainment. Thus, other "win-criteria" leading to less frustrating experiences may be used. They are of two basic classes: (1) time dependent, and (2) achievement dependent. The first class criterion is determined by the distance that the ball travels along a prefered direction during a certain amount of time. The second class criterion is defined by the distance travelled from a starting point by the ball until either one player concedes the game or the ball reaches one end of the bars. In the first instance, a point-system of counting can be used. In the second instance, bar-end reaching by the ball constitutes a perfect win, which may take a long time to achieve and which also enables a "losing" player to concede the game before the end of such perfect game. The losing player than has a chance to start again on a point-counting basis and to try his (her) luch or skill again in the same game. Other types of win-criteria may be devised by the apparatus users to suit their particular own preferences.

General Operation of the Alternate Embodiment:

Having now defined various manners in which the alternate embodiment of the present invention can be utilized, a general way by which the apparatus is caused to operate may be discussed. It applies equally to single-player game usage and to two-competing-player game usage. Firstly, the bar relative positioning arrangement needs be discussed. Secondly, the restoring force spring system warrants some elaboration. Thirdly, the bar/ball types of interaction and the potential exploitation thereof by players deserves further elaboration also.

Generally, in a one-player game configuration, three openings such as 165, 185 and 186 are located on the same end structure 141, whereas two supporting flanges, one for each set of holding fingers 161, 161' and 161'', are both located on the other end structure of the apparatus. Thus one end structure provides either for three or two openings such as 165 and no or one holding-finger-supporting flange, depending on whether one single player controls both bars 22' and 23' or one player controls bar 22' whilst a second player controls bar 23' (or 22'') from the other end, in which case that end structure houses two openings such as 165 and one flange only. The schematic representations of FIGS. 18 and 19 both pertain to the case of a single player use and are given for understanding guidance only. The reader may easily derive the pertinent opening configuration for two players. Construction provisions, not shown for simplicity sake, are made so that supporting flanges and spring system assembly 190 mountings may be inverted in the case of bars 22' and 23' (22'').

Bar Positioning Arrangements:

Only two typical arrangements of the relative positioning of the three bars are discussed here, being deemed most basic. The first arrangement is depicted in FIGS. 11 and 18. The second arrangement is depicted in FIGS. 14 and 19. FIGS. 18 and 19 illustrate how the two controlled bars may be radially guided in their inwardly displacements and laterally constrained. In both arrangements, guide bar 21' may move radially vertically and is laterally fully restrained.

In the first bar arrangement, the radial components of the controlled bar partial weights and the inwardly-directed forces exerted by their their spring system assemblies 190, one for each bar, are applied onto ball 20' at points B and C. The resultant force is then transmitted to bar 21' which distributes this resultant force between its two own spring system assemblies 190. The player(s) may add or subtract a control force directed either inwardly or outwardly on either control bar. Such additional force affects the degree of interaction between the bars and the ball, as well as the vertical position of bar 21' and the locations of points B and C on the ball. One player or both players are thereby given an opportunity to affect the ball response and behavior in a direct fashion.

Openings 165 for the guide bar are always directed radially for symmetry reasons. This may not be so for openings 185 (185') and 186 (186'), but not necessarily. Three typical cases of opening orientation are shown in FIGS. 18 and 19 as examples of extreme orientation variations and one intermediate orientation. The arrows shown in dotted lines indicate the direction in which the bar shafts are then guided by the opening side faces. Readers will undoubtedly understand how the opening orientation affects both the action of a bar on the ball and the degree by which any force exerted by a player on the bar handle is transmitted to the ball. Incidentally, the orientation of each opening 185 (185') and/or 186 (186') can be adjusted independently by a player when agreed upon at the start of a game, and by different amounts.

Restoring Force Spring System:

Contrary to the case of the preferred embodiment, without the existence of a ball recall restoring force, the alternate embodiment provides no difficulty to a single player, thus no challenge whatsoever. However, in the case of two competing players, a ball reaction is not mandatory, especially if both players have control of an actuation bar, each. If one player has control of one actuation bar and if the other player has control of the obstacle bar, the presence of a restoring force opposing the ball movement may have some importance. In such case, one line and one recall spring system suffice and the ball starting point then is the apparatus end on which the spring system is located. The magnitude of the restoring force thus increases as the ball moves further away from the starting point. The ball full travel is then equal to almost the full length of the bars.

If each player has control of one actuation bar, each bar action opposing the effects of the other bar action, game symmetry is achieved and the restoring force must be applicable onto the ball in either direction. Because a flexible line can only pull, but not push, two tension lines are required, hence also two recall spring systems, one at each end of the apparatus. This case is illustrated in FIG. 11. The stiffnesses of both springs add and the value $\Delta F = F1 - F2$ is the net force applied to the ball. For reasons of symmetry, both springs should be set identically and the ball is given the choice of moving ring or left in direction X. Therefore, the ball starting point is most logically the mid-way point between the two bar ends. Because the ball may move either way when urged properly, a preferred direction must be agreed upon by both players at the beginning of a game. For reasons of symmetry again, there is no justification for selecting a priori either direction. But a convention must be established to which both players agree to adhere. For instance, it may be mutually agreed that each player will attempt to bring ball 20' as close as possible to his (her) end of the apparatus. When such selection is made, both players must give serious consideration to the pitch angle orientation of his (her) actuation bar helix and the rotation direction that must be given to the bar.

If both bars rotate in the same direction, they both contribute to the ball rotation. If the bars rotate in different directions, one hinders the action of the other on the ball. For each player, the bar controlled by the other player rotates in a direction inverse from that which it would have if both players were on the same end of the apparatus. Two bars 22' identical but inverted and with their handles being rotated in the same direction by their respective players will urge the ball in opposite directions, which provides the competitive challenge desired. For reasons of symmetry again, guide bar 21' must present obstacles of the same type and nature which are symmetrically positioned with respect to the apparatus mid-plane orthogonal to direction X. At this juncture, both players have an equal change at the game start. The ball is in equilibrium under the actions of both recall springs and, assuming that the ball surface coating and/or nature are symmetrical about ball axis P-Q, the only variable left to the player's choice is the bar angular starting position that seems most propitious.

If rubber bands are used instead of line-spring systems, the rubber bands may be given two equal but opposite pre-set initial torques. Also, to avoid mechanical interferences of the rubber bands with the bar/ball interactions, the rubber bands are given an initial tension. Bracket 177 may be located on the other side of end structures 141 so as to assume the function of spring 157 housing, then no longer needed. As mentioned in the preferred embodiment discussion, rubber bands also provide here a coupling between ball translation and rotation, which can be expoited by either player.

Bar/Ball Interaction Modes:

As earlier defined, the win-criteria used in the case of the alternate embodiment do not preclude retreats of the ball during its forward progression. As long as the sum total of the progressions in the chosen preferred direction exceeds the sum total of the retreats for one of the players during a two-player game, such a player will win that game.

The types of ball retreat mentioned above are only of a strategic or tactical nature, they are and should not be needed in a general case by a mechanical interference of the kind previously noted. It is hereinafter assumed that the external surface profiles and contours of bars 22', 22'' and/or 23' are such that total mechanical interference is always avoidable by means of the compliance provided by guide bar 21' and the sliding of its shafts along opening 165 side faces or tracks. The bar/ball interactive behavior is discussed below in that context only.

It was earlier mentioned that all bar shafts arre spring loaded so that contacts are constantly and continuously maintained between the surfaces of the three bars and of the ball. Also, the spring loading applied to the guide bar shafts is appreciably higher than the maximum spring loading which can be developed by the springs pushing on the other bar shafts. The springs pushing on the shafts of these two bars also have a stiffness much lower than that of the guide bar shaft loading springs. Thus, at rest (starting point position), the net axial force acting on the ball is negligible, the shafts of bar 21' are against their respective stop blocks 172, the shafts of bar 22' and 23' (or 22") (one shaft per bar), are all pushed inwardly to the extent where the bars transmit these pushing loads to the ball and then to the guide bar. An appreciable increased amount of inward push on the handle of either bar by a player then causes bar 21' shafts to overcome the forces developed by springs 170 and the shafts will move outwardly away from stop blocks 172 (FIG. 15). The ratio of the radial displacements incurred by both shafts depends upon the ball location according to the leverage created by both the bar being pushed and the guide bar. In a one-player game, the above ratio is the same for both controlled bars, whereas, in a two-player game, the magnitudes of the above ratio vary in inverse proportion for one bar as compared to the other, save when the ball is in the mid-way location, for symmetry reasons.

From the above discussion, keeping in mind the previous description and discussion of the actuation bar/-ball interactions and operation in the case of the preferred embodiment, the reader will easily visualize the large number of options and possibilities presented to each player of a game. Also, because the relative importance and magnitudes of the ratios defined above vary continuously as the ball progresses axially in either direction, a constant reassessment of the situation, difficulties and opportunities presented thereby, and of the next move is constantly required of a player. In addition to the complexity created by the ball changes of location, either player must cope with those perturbations in any assessment results caused by the other player's actions by means of the bar he (she) controls. The number of combinations of move possibilities is very large indeed and experience, training and manual skill play a role of paramount importance in winning a game.

A final usage mode of the alternate embodiment, not mentioned in the case of the preferred embodiment, is that which involves the use of two actuation bars, one of each bar being controlled by one of the two competing players. In this game mode, the ball is positioned mid-way between the bar ends. Both actuation bars are identical and the players decide which winning criterion is to be used: (1) bring the ball as close as possible to the player's end of the apparatus, or (2) push the ball as far away as possible from the player's end of the apparatus, i.e. as close as possible as to the other player's end of the apparatus. In such a game, if the surfaces of the bars and the ball displayed identical and uniform friction characteristics a winnable game might still be possible between two players of equal skill and experience but having different degrees of patience and/or alertness. However, such game eventuality is not a prime object of this embodiment usage. As is the case for the preferred embodiment, the surfaces of the actuation bars and/or of ball 20' exhibit considerable variations in their sliding friction coefficients, from place to place, along and about these surfaces. Thus, each player is enabled to exploit such variations in friction to his (her) own advantage and/or to his (her) adversary's disadvantage. Such exploitation decision can be made before any move is made by either player or forced by the other player onto one's opponent.

Consequently, even when the bar and ball angular positions are set at the start of a game to reflect perfect symmetry of action on and reaction by the ball, such status quo situation cannot last long and can be very quickly upset or changed by either player who takes the first initiative to depart from such "dead center" predicament. From this point onward, it is up to either player to act and react to maintain the highest degree of control over the game development. Various ways and manners by which either player is enabled to act and react to that effect include: (1) bar handle rotation, (2) bar handle radial motion, inwardly and/or outwardly, (3) amount of inward pushing exerted on the bar handle, and (4) any combination thereof to any degree of swiftness and emphasis. However, it is noted again that none of the forces pushing against the ball from any bar action can be relieved or decreased below a set level determined by springs 170 adjustments and the ball location along axis X.

These spring-170 minimum set loads can be adjusted at a game start to correspond to a level high enough to prevent the ball from sliding on the bar surfaces in the combined cases of both minimum friction and maximum ball travel, at one extreme limit of adjustment options. The springs may also be adjusted to a level corresponding to the combination of maximum ball travel and maximum friction. Finally, they may also be adjusted so that at some intermediate ball location between the starting point and the bar ends, in the case of maximum friction, the ball will begin sliding unless greater pushing forces are applied by the players on the bars by means of their handles.

Insofar, no mention has been made of bars 22', 23' (22") general shapes which were assumed conical in the case of the preferred embodiment. In the case of the alternate embodiment, for the reason of symmetry previously mentioned, it has been assumed as shown in FIG. 11 that any bar general shape is cylindrical. In other words, any local surface shape deviations therefrom are considered as being deviations from an ideal basic cylindrical profile. It should be noted that this is neither an operational nor a functional requirement, but an illustrative choice.

In conclusion, the invention alternate embodiment provides as many and as difficult challenges as does the preferred embodiment. The challenges are of different natures but require the same types of arm, wrist, hand and finger coordinated movements. Two basic and important differences are worth noting however. In the case of the preferred embodiment, the player's body is generally parallel to the bar longitudinal axes and to the ball direction of motion. In the case of the alternate embodiment, the player's body is generally perpendicular to the bar longitudinal axes and to the ball direction of motion. This means that the bar handles must be held differently and that the corrdination and relative importance of the arm, wrist, hand and finger motions and control thereof must also be radically different and adapted thereto. This makes the usages of both embodiments complementary and hardly excludatory. This points to the advantage of an apparatus construction which permits adaptation to either usage, by means of few and simple changes to the end structures. Such changes either will be obvious to readers familiar with the art or have already been mentioned and need no further elaboration here.

The second difference stems from the fact that two players are obligated to play the preferred embodiment from the same end of the apparatus, making it perhaps awkward and difficult. Whereas the alternate embodiment can be played by two players, each having ample elbow room, which is necessary here because of the handle horizontal position. It will seem obvious from the foregoing that the bar handles are best held by finger tips. Also, because of the increasing influence assumed by the recall spring as the ball moves farther away from its starting point, pitch angle $\alpha$ could be caused to decrease from the ball starting point station onward, for ease of ball 20' urging.

Inclined Alternate Embodiment Configuration:

Finally, it might prove advantageous to position the bar longitudinal axes in a inclined attitude so as to use only a fraction of the ball weight as resisting force and render the maneuvering of the handles easier for some players. Such inclined attitude corresponds to an intermediate position between horizontal and vertical. This can easily be provided by means of a hinged adjustable articulation located between structure 40 and supporting table (or desk) top 35 (or 150). The axis of such articulation is perpendicular to the axis 0 (FIG. 1) or line P'-Q' (FIG. 11) and can be located any place between the two end structures 141 and 141' as shown in phantom lines for reference in the schematic diagram of FIG. 11.

Pedestal 200 rests on or is clamped to a supporting structure (not shown) and has two protruding journaled lugs 201 and 202 supporting hinge axle 203 which engages a middle journaled lug 204 that is jutting down from the bottom surface of structure 40, partially shown. The slope of the inclination thus provided is adjustable according to the degree of tilting imposed on structure 40 and can be set and maintained by a locking mechanism, well known in the art, needing no description here. To give more rigidity and steadiness to the assembly formed by the pedestal and supporting structure 40, an articulated structural bracing member (not shown in detail, being well known in the art) can connect pedestal 200 to structure 40. This is schematically illustrated by stem 206 articulated at one end at fixed point N and having the other end positioned at point M in holding grooves such as 207 located along the length of structure 40 bottom face. In addition, the length of stem 206 can be made adjustable to and lockable at various set length values so that the inclination of structure 40 can be adjusted and held in a fixed attitude. Stem 206 positioning mechanism can be used in conjunction with the adjustment and locking device mentioned above in connection with axle 203 or by itself.

The description and operation discussion of the invention as previously given are elaborate enough that no additional discussion of the operation of the apparatus in an inclined position seems warranted here. The reader will see how players are given the possibility of gradually varying the transition in difficulty and challenge from the two extreme positions previously described and thoroughly discussed.

CONCLUDING REMARKS

The apparatus herein described and discussed, in its two embodiments, with its many variations, provides a fun toy and teaching tool, means for playing games of skill and improving such skill, means for measuring such skill and improvements thereof, and as a physics teaching tool means for demonstrating examples of body statics and balancing by means of friction. The degrees of skill, understanding, teaching and/or dexterity development can be made very gradual between very wide extremes. The possibility presented by the apparatus to be easily transformed so as to require the application of the same skill about two orthogonal directions provides a diversity in manual ability training seldom offered by the same apparatus.

The apparatus also has many uses as a training tool for people who must develop movement coordination of either one or both hands and fingers. This could apply to various types of professionals whose dexterity and manual skill are vital. It also has applications in the field of some handicapped rehabilitation and child manual ability developement.

It is thought that the three-bar/ball apparatus of the present invention and many of its attendant advantages will be understood from the foregoing description and it will be apparent that various changes may be made in the form, construction and arrangement of the parts thereof without departing from the spirit and scope of the invention or sacrificing any and all of its material advantages, the form hereinbefore described and discussed being merely preferred examplary embodiments thereof.

Having thus described my invention, I now claim:

1. A game apparatus, comprising:

three elongate bars positioned generally parallel and having a generally circular cross-section that gradually increases and decreases in diameter along a longitudinal axis thereof;

means for supporting a first end of each of the bars so that the first end can be freely articulated about a corresponding reference point and rotated about its longitudinal axis;

means for holding a second end of each of the bars for perpermitting manually induced movement toward and away from each other along a lateral path, for permitting the second ends to be manually moved to articulate the first ends about their corresponding reference points and for permitting the second ends to be manually rotated about their corresponding longitudinal axes;

a ball located between the three bars and supported by the external surface of each one of the bars by means of point contact;

means located on at least one first bar for urging the ball to move lengthwise along the bars against a resisting force when said bar is rotated about its longitudinal axis, said bars being so located as to restrain said ball against lateral movement; and a structure for connecting the supporting means of the first ends to the holding means of the second ends.

2. A game apparatus according to claim 1 wherein means is provided for maintaining the three bars substantially vertically, thus enabling the ball to rise by moving upwardly against gravity.

3. A game apparatus according to claim 2 wherein the means for urging the ball upwardly is provided by the surface of the bar being rotated, said surface being defined by the envelope of its circular cross-section contours, the locus of the centers thereof forming an helix around said bar longitudinal axis.

4. A game apparatus according to claim 3 wherein the second end of one second bar used for guiding the ball upwardly is prevented from moving when adjusted, and further comprising:

means for temporarily adjusting a lateral position of said second end, said lateral positioning taking place in a plane substantially orthogonal to the bar longitudinal axis.

5. A game apparatus according to claim 2 wherein means is provided by the second end holding means for installing and removing either one of the three bars.

6. A game apparatus according to claim 2 wherein means is provided by the first end holding means for adjusting the positioning of the reference point of any bar so as to vary the degree of urging for upward motion of the ball as provided by the rotating bar.

7. A game apparatus according to claim 2 and further comprising:

means for assembling and disassembling any of the bars so as to enable a game player to alter and to adjust the contour of the bar external surface.

8. A game apparatus according to claim 7 wherein the bar assembling and disassembling means includes a plurality of segments, a programmed assembly of said segments forming the bar gradually changing external surface, said apparatus further including:

an elongated stem for supporting and positioning said segments between the bar first end and second end;

a handle for positioning and rotating the bar;

means for permitting rotation of the segments on the stem;

means for permitting rotation of any segment relatively to a contiguously located segment; and means for locking at least two contiguous segments together.

9. A game according to claim 8 further comprising:

means for locking the segments located nearest to the first and second ends to the stem-handle assembly.

10. A game apparatus according to claim 8 and further comprising:

means for locking the second bar second end in place so as to enable the bar to remain fixed during a game and be used as a guide;

means for enabling the second end of the first bar having the urging means to rotate and to move laterally by means of the game player's first hand action so as to enable said first bar to be used for actuation of the ball; and means for enabling one third bar second end to be moved laterally and rotated by the game player's second hand action so as to urge the ball to maintain contact continuously and simultaneously with the three bars.

11. A game apparatus according to claim 10 wherein the second bar includes:

means for instantly and unequivocally indicating the height reached by the ball during its ascending travel for scoring purpose and recording thereof; and means for enabling the game player to pause and relax when a height scoring level is reached before attempting to raise the ball to the next higher up scoring level.

12. A game apparatus according to claim 11 wherein the upward movement of the ball can solely be caused by neans of the coordinated and conjugate actions of both hands of the game player in a manner such that an upwardly diverging solid angle is constantly and continuously being formed by the three planes containing the ball-bar contact points, said thus formed solid angle being constantly and continuously given the opportunity to become nil and even becoming slightly upwardly converging by means of the actuation bar, said apparatus further comprising:

bar-to-ball interacting friction means for preventing a slightly upwardly converging solid angle from allowing the ball to fall to a lower level; and means for constantly and continuously providing combinations of ball-bar surface relative positions and frictions that enable a skilled game player to lift the ball from the first end to the second end of the scoring guide bar in a continuous fashion;

whereby the apparatus provides to game players means for measuring, developing and improving their skills.

13. A game apparatus according to claim 2 wherein the ball comprises:

means for programmatically changing and adjusting the radial position of its center of gravity; and means for disassembling the reassembling two quasi halves of the spherically-shaped ball so as to enable game players to adjust the ball center of gravity location and weight.

14. A game apparatus according to claim 2 wherein a portion of the external surface of the ball is coated so as to locally alter the friction coefficient of said surface in a predetermined and significant manner.

15. A game apparatus according to claim 2 wherein a portion of the external surface of any of the bars is coated so as to locally alter the friction coefficient of said surface in a predetermined and significant manner.

16. A game apparatus according to claim 1 and further comprising means for enabling two competing players to match skills and win a game by exercizing and applying one's superior skill.

17. A game apparatus according to claim 1 wherein the second end of at least one bar is radially and complyingly pushed so as to urge said bar to push against the ball, and further comprising:

spring means for exerting said radial push; and spring adjusting means for setting the amount of said push.

18. A game apparatus according to claim 1 wherein protruding members can be locally and temporarily mounted on the external surface of at least one bar so as to increase the level of difficulty and challenge presented to a player, and further comprising:

means for securing said member on the bar structure; and means for removing said member.

19. A game apparatus according to claim 2 wherein the external surfaces of the bars and of the ball can be locally changed without affecting the surface continuity, and further comprising:

means for securing bands on said surfaces; and means for removing said bands from said surfaces.

20. A game apparatus according to claim 1 wherein means is provided for installing the three bars in either one of two positions, substantially vertically and horizontally.

21. A game apparatus according to claim 1 wherein means is provided for setting the bar longitudinal parallel axes along inclined positions so as to enable the ball to travel along a correspondingly inclined path.

22. A method of measuring, developing and improving the manual dexterity and skill of an operator by means of a ball cooperating with three generally parallel-positioned elongate bars having quasi circular cross-sections which gradually increase and decrease along the length of the bars, the ball being positioned by and restrained between the bars, the bars being restrained axially and supported each at one of their two ends by a fixed supporting structure, two bars having a manually rotatable and horizontally moveable handle at the other end, the third bar being restrained at each one of its ends by the supporting structure, the cross-sections and external surfaces of said bars varying according to their lengthwise locations in a manner such that the ball is urged to move along the bars against a resisting force by means of the cooperating and conjugate interactions between the ball and the bars against the pull of said force while the ball displacement is caused to increase in difficulty as the ball move further from a starting point in an effort to travel to a bar end, a first one of the two moveable bars being shaped so as to urge the ball onward when rotated in a set direction, a second one of the two bars being shaped so as to enable the operator to apply a laterally directed push on the ball against the first and third bars, said method comprising the steps of:

securing the third bar in place in a preset position;

placing the ball at the starting point between the bar ends;

holding the two handles, one in each hand, and rotating the urging bar while pushing it against the ball with one hand;

simultaneously, resisting said push as needed by laterally pushing the handle of the second bar in a direction pointing substantially midway between the other two bars with the other hand; and concurrently, as deemed justified by the operator, move the handles sideway with respect to the lateral direction so as to maintain the ball in a position relatively to the bar surfaces such that the planes tangent to the bars and ball surfaces at the three support points of the ball form a solid angle having sides that diverge in an onward direction to be followed by the ball, constantly and continuously during the ball onward motion.

23. The method recited in claim 22 wherein means is provided for maintaining the bars substantially vertically and moving the ball upwardly, the resisting force being generally gravity.

24. The method recited in claim 23 wherein the third bar includes means for indicating the height level to which the ball has upwardly risen, said method comprising the further steps of:

visually ascertaining that the ball rise has progressed gradually upward without any momentary descent of the ball; and visually detecting and recording the location on the third bar where the ball falters and stops rising, whereby a measure of the operator's skill and dexterity becomes obtainable.

25. The method recited in claim 24 wherein the degree of difficulty can be adjusted to increase and to decrease according to the locations of the ball-bar contact points on the surfaces of the ball and the bars, said degree of difficulty being function of the coefficient of sliding friction between the ball and bars surfaces at said contact points, and portions of the ball and of the bar surfaces are coated so as to substantially increase and decrease said friction coefficients, said method comprising the further steps of:

concurrently and simultaneously pushing and rotating the two handles so as to maneuver the ball into a position for which the friction forces developed between the ball surface and each one of the surfaces of the bars are such that the probability of the ball moving upwardly is maximized.

26. The method recited in claim 24 wherein means is provided for adjusting the ball center of gravity location and weight, and for disassembling and reassembling the ball, said method comprising the further steps of:

opening the ball into two quasi halves and removing a plurality of ballast weights;

rearranging the ballast weight amount and location according to the operator's selection; and securing the ball two halves together;

whereby ball responses to maneuver solicitations from the operator by means of the two bar handles are altered, whereby a higher degree of skill of the operator is required to play.

27. The method recited in claim 24 wherein means is provided for separating the second and third bar external surfaces into segments capable of rotation independently from each other and from the bar handles, said method comprising the further steps of:

arranging the segments in a predetermined order so as to impose a set contour onto the two bars; and starting a new game for which the ball responses to the urgings of the first bar and to the rotation and lateral pushing of the second bar are different from those encountered during a preceding game, thus raising the challenge level.

28. The method recited in claim 24 wherein means is provided for increasing the resistance of the ball to upward motion urging as the ball rises and with the total amount of rotation imposed on the ball, said method comprising the further steps of:

concurrently and simultaneously operating the first bar and second bar handles so as to attempt to make the ball rise a given amount with a minimum amount of rotation, so that the gradual increase in the degree of difficulty presented by the ball rise occurs at a minimized rate.

29. The method recited in claim 22, wherein means is provided for maintaining the bars substantially horizontally and moving the ball in a generally horizontal direction against a spring force.

30. The method recited in claim 22 wherein means is provided for keeping score and for enabling two competing players to play against one another to win a game, said method comprising the further steps of:

establishing a criterion determining the completion of a game;

establishing a criterion difining the scoring method;

enabling each player to urge the ball as far away as possible from the starting point according to the scoring criterion;

enabling either player to win the game by exercizing superior skill and applying it for scoring high; and each player attempting to urge the ball away to reach the highest score while attempting to prevent the other player from scoring and from hindering the scoring player in one's attempt.

31. The method recited in claim 22 wherein means is provided for installing the bars in either one of the two positions, substantially vertical and horizontal, said method comprising the further steps of:

urging the ball to rise as high as possible between the three vertical substantially parallel bars; and urging the ball to travel as far away as possible from the starting point along the three horizontal bars and therebetween.

32. The method recited in claim 22 wherein means is provided for setting the longitudinal axes of the bars into an inclined position intermediate between vertical and horizontal directions so as to enable the ball to travel along a correspondingly inclined path, said method comprising the further steps of:

selecting an inclination angle for the bar longitudinal axes and the ball travel general path; and adjusting the setting means to said inclination angle.

* * * * *